US007063003B2

(12) United States Patent
Tagami

(10) Patent No.: US 7,063,003 B2
(45) Date of Patent: Jun. 20, 2006

(54) SWASH PLATE-TYPE COMPRESSOR

(75) Inventor: Shinji Tagami, Isesaki (JP)

(73) Assignee: Sanden Corporation, Gunma (JP)

( * ) Notice: Subject to any disclaimer, the term of this patent is extended or adjusted under 35 U.S.C. 154(b) by 33 days.

(21) Appl. No.: 10/782,803

(22) Filed: Feb. 23, 2004

(65) Prior Publication Data

US 2004/0163533 A1 Aug. 26, 2004

(30) Foreign Application Priority Data

Feb. 21, 2003 (JP) ..... 2003-045062

(51) Int. Cl.
*F01B 3/00* (2006.01)

(52) U.S. Cl. ..... 92/12.2; 92/71

(58) Field of Classification Search ..... 92/12.2, 92/71; 417/269; 384/26, 42, 276, 420
See application file for complete search history.

(56) References Cited

U.S. PATENT DOCUMENTS 4,568,252 A * 2/1986 Hattori et al. ..... 417/269
5,382,144 A 1/1995 Tanaka ..... 418/55.3
5,875,702 A 3/1999 Kawagoe et al. ..... 92/12.2
5,974,946 A 11/1999 Kanou et al. ..... 92/71
6,189,434 B1 * 2/2001 Kawaguchi et al. ..... 92/71
6,192,784 B1 * 2/2001 Kato et al. ..... 92/71
6,217,295 B1 * 4/2001 Kato et al. ..... 417/269
6,457,399 B1 10/2002 Jingu ..... 92/71
6,823,768 B1 11/2004 Tagami ..... 92/71
6,905,246 B1 * 6/2005 Iwata et al. ..... 384/42
2003/0000376 A1 1/2003 Sugiura et al. ..... 92/70

FOREIGN PATENT DOCUMENTS

JP H5702881 2/1982

* cited by examiner

*Primary Examiner*—Edward K. Look
*Assistant Examiner*—Igor Kershteyn
(74) *Attorney, Agent, or Firm*—Baker Botts L.L.P.

(57) ABSTRACT

A swash plate-type compressor included a rotatable swash plate and a piston. The piston is connected to the swash plate via at least one shoe and reciprocates in company with each rotation of the swash plate. The swash plate has a layer of a sintered metal impregnated with a resin on at least a swash plate surface sliding against the at least one shoe. A surface of the impregnated layer is ground.

19 Claims, 3 Drawing Sheets

SWASH PLATE-TYPE COMPRESSOR

BACKGROUND OF THE INVENTION

1. Field of the Invention

The present invention relates to a swash plate-type compressor for use in an automobile air conditioning system.

2. Description of Related Art

As disclosed in Published Patent Application No. US2003-000376, a swash plate-type compressor for use in an automobile air conditioning system includes a rotatable swash plate and a piston connected to the swash plate via shoes, such that the piston reciprocates in company with each rotation of the swash plate. The swash plate secures efficient lubrication to prevent seizure of swash plate surfaces sliding against the shoes when the compressor is working under a heavy load. Therefore, the swash plate includes layers of a sintered metal on the swash plate surfaces which slide against the shoes and layers of a resin on the layers of the sintered metal.

Accordingly, the layers of the resin are joined securely with the layers of the sintered metal, which sintered metal layers have fine pits and lands on surfaces of themselves. Consequently, a superior sliding-contact against the shoes may be achieved and seizure of the swash plate surfaces sliding against the shoes may be prevented from occurring at an early stage of compressor operation.

Nevertheless, the layers of the resin do not have a high degree of abrasion resistance when compared with the layers of the sintered metal. Thus, the layers of the resin may be worn away by abrasion at an early stage of compressor operation. Therefore, clearances for forming films of oil in between the swash plate and shoes may become much too large. Such clearances may cause tracking between the swash plate and shoes, and in a worst case, they may cause the swash plate surfaces sliding against shoes to seize.

SUMMARY OF THE INVENTION

Therefore, a need has arisen for a swash plate-type compressor for use in an automobile air conditioning system that overcomes these and other shortcomings of the related art. A technical advantage of the present invention is that it achieves a superior sliding-contact and prevents seizure of the swash plate surface sliding against at least one shoe.

In an embodiment of this invention, a swash plate-type compressor comprises a rotatable swash plate and a piston. The piston is connected to the swash plate via at least one shoe and reciprocates in company with each rotation of the swash plate. The swash plate has a layer of a sintered metal impregnated with a resin on at least a swash plate surface sliding against the at least one shoe. A surface of the impregnated layer is ground.

In another embodiment of this invention, a method for manufacturing a swash plate-type compressor is described. The compressor comprises a rotatable swash plate and a piston. The piston is connected to the swash plate via at least one shoe and reciprocates in company with each rotation of the swash plate. The method comprises the steps of sintering a metal on the swash plate surface, impregnating a resin in a layer of the sintered metal, hardening the resin, and grinding the surface of the impregnated layer.

Other objects, features, and advantages of embodiments of this invention will be apparent to, and understood by, persons of ordinary skill in the art from the following description of preferred embodiments with reference to the accompanying drawings.

BRIEF DESCRIPTION OF THE DRAWINGS

Embodiments of the invention now are described with reference to the accompanying figures, which are given by way of example only and are not intended to limit the present invention.

DETAILED DESCRIPTION OF PREFERRED EMBODIMENTS

Figure 1:
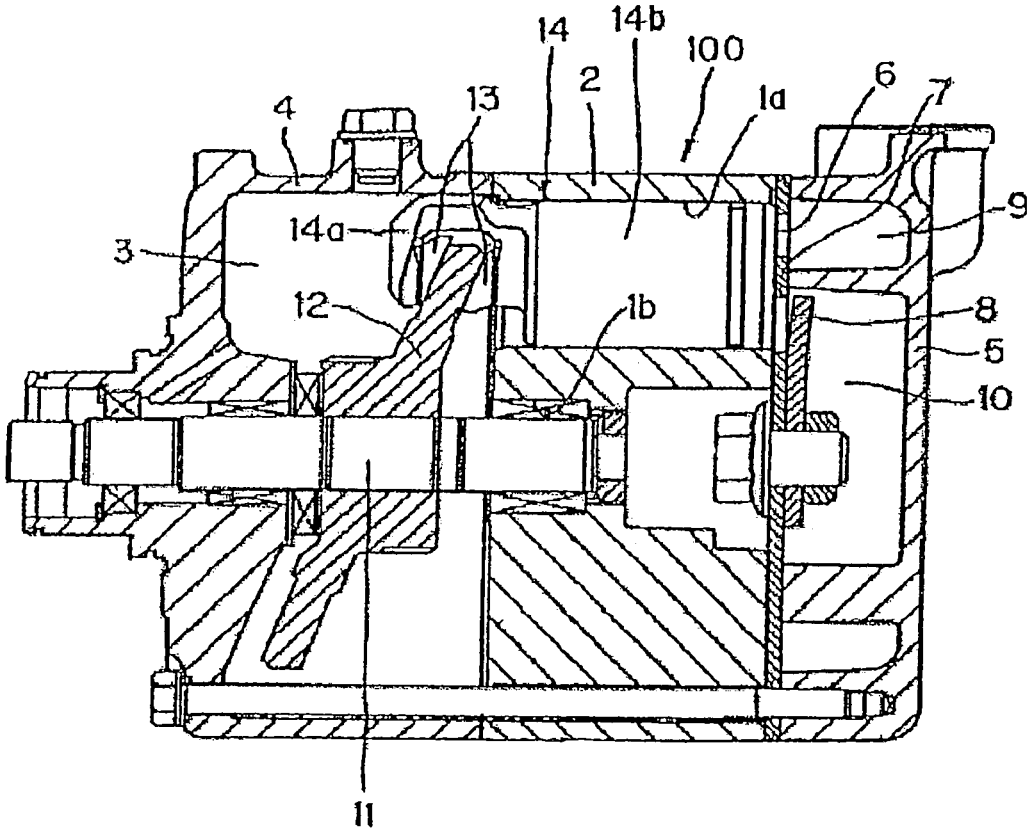
FIG. 1 is a cross-sectional view of a swash plate-type compressor, according to embodiments of the present invention.

Referring to FIG. 1, an embodiment of the present invention of a swash plate-type compressor for use in an automobile air conditioning system (not shown) is shown. A compressor 100 comprises a cylinder block 2 having a plurality of cylinder bores 1*a* and a central bore 1*b*, and a front housing 4 forming a crank chamber 3 in cooperation with cylinder block 2. A cylinder head 5 encloses a suction valve 6, a valve plate 7, and a discharge valve 8, in cooperation with cylinder block 2. Cylinder head 5 comprises a suction chamber 9 and a discharge chamber 10 within its interior. Suction chamber 9 is connected to a suction port (not shown), and discharge chamber 10 also is connected to a discharge port (not shown).

Compressor 100 comprises a drive shaft 11 extending across crank chamber 3 and penetrating through crank chamber 3. Drive shaft 11 is supported rotatably by front housing 4 and central bore 1*b* of cylinder block 2.

A swash plate 12 made from a ferrous alloy is fixed rotatably to drive shaft 11 within crank chamber 3. A plurality of pairs of shoes 13 slidably abut peripheral portions of swash plate 12 and are positioned to leave a space therebetween. Each of the pairs of shoes 13 are held in place within a holding portion (not shown) formed at a tail portion 14*a* of a piston 14. A head portion 14*b* of piston 14 is inserted slidably into cylinder bore 1*a*.

In compressor 100, drive shaft 11 is driven by an external power source (not shown), swash plate 12 also is rotated by rotating of drive shaft 11. Piston 14 is connected to swash plate 12 via shoes 13 and reciprocates in company with each rotation of swash plate 12. Refrigerant returned to compressor 100 from an external refrigeration circuit (not shown) is drawn into cylinder bore 1*a* via the suction port, suction chamber 9, a suction hole through valve plate 7, and suction valve 6, and is returned again into the external refrigeration circuit as a result of the compression in compressor 100 via discharge hole through valve plate 7, discharge valve 8, discharge chamber 10, and the discharge port.

Figure 2:
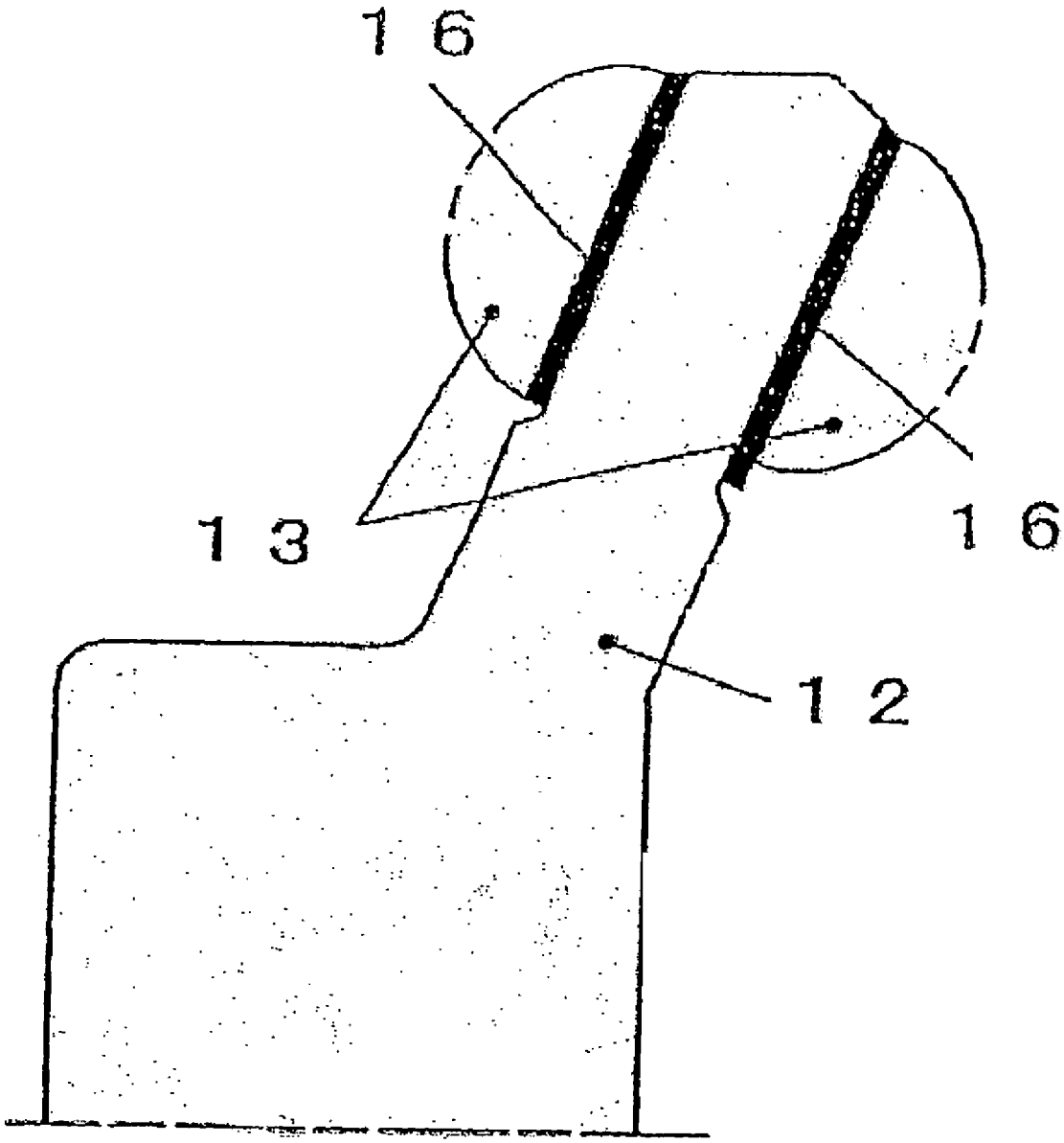
FIG. 2 is a cross-sectional view of a swash plate for the swash plate-type compressor that includes peripheral parts, according to embodiments of the present invention.
Figure 3:
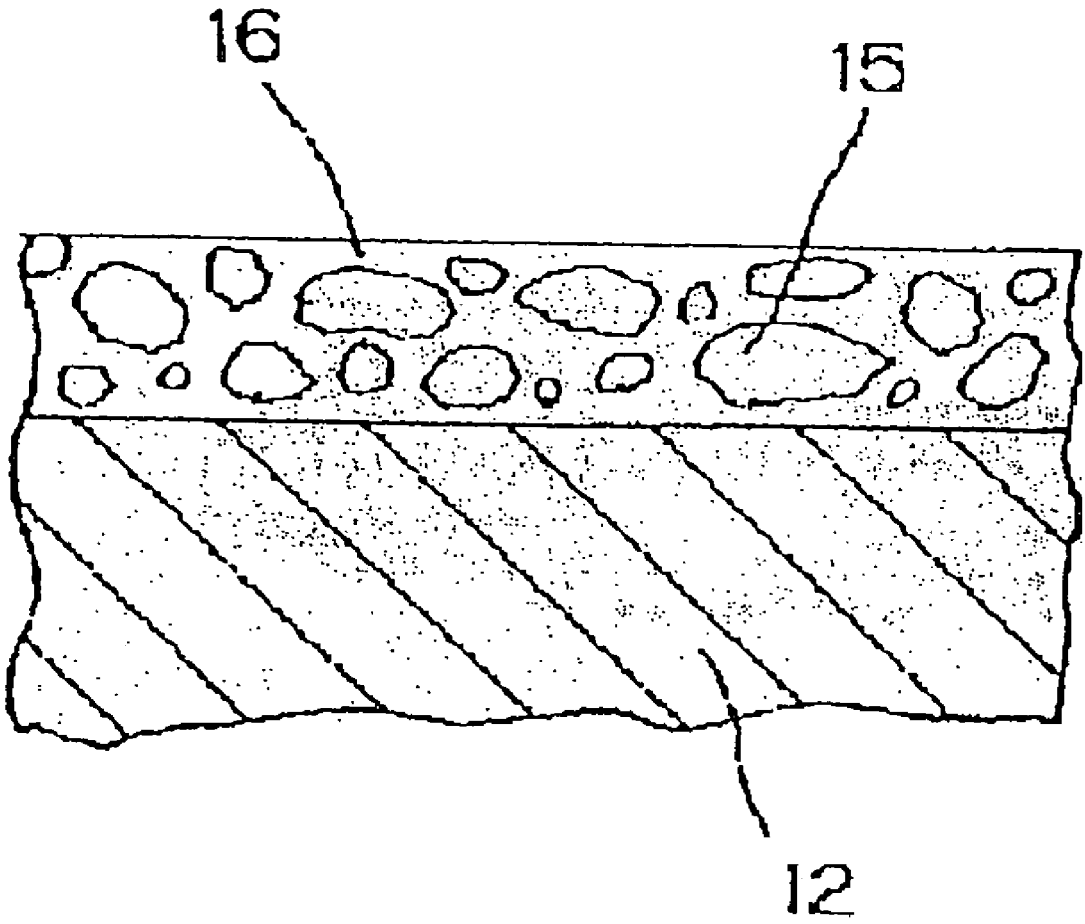
FIG. 3 is an enlarged cross-sectional view showing a portion of a swash plate surface sliding against a shoe, according to embodiments of the present invention.

As shown in FIGS. 2 and 3, swash plate 12 comprises layers 16 of a sintered metal consisting of a copper alloy or an aluminum alloy on swash plate surfaces sliding against shoes 13, and a resin 15 is impregnated in layers 16. Resin 15 is made from a material selected from the group consisting of an epoxy resin, a phenol resin, a polyimideamide resin, a polyimide resin, a polyetheretherketone resin, and combinations thereof. Such layers 16 are formed as follows. Initially, layers 16 are formed by sintering the metal on swash plate surfaces. Subsequently, molten or softened resin 15 is impregnated in layers 16 of the sintered metal. Finally, surfaces of layers 16 are ground after resin 15 hardens. Therefore, resin 15 covering is removed with surfaces of the layers 16.

As shown in FIG. 3, in compressor 100, because surfaces of layers 16 of the sintered metal impregnated with resin 15 are ground, the metal forming layers 16 and resin 15 simultaneously slide against shoes 13. Moreover, because resin 15 fills cavities within layers 16 and the circumference of the resin-filled cavities are surrounded by the metal particles, resin 15 seldom disappears due to abrasion. Therefore, a superior sliding-contact against shoes 13 may be achieved and seizure of swash plate surfaces sliding against shoes 13 may be prevented from occurring at an early stage of compressor operation.

In this embodiment, shoes 13 are made from a ferrous alloy, and metal layers 16 are made from a copper alloy or an aluminum alloy. Thus, the material of layers 16 differs from the material of shoes 13. Therefore, seizure between layers 16 and shoes 13 is prevented from occurring at an early stage of compressor operation.

Further, thermosetting resins and thermoplastic resins are suitable for resin 15. Because thermosetting resin exhibits superior heat resistance and mechanical intensity, and thermoplastic resin exhibits superior heat resistance, either resin is suitable for use for swash plate surfaces sliding against shoes 13. As an example, any of or combinations chosen from an epoxy resin, a phenol resin, a polyimideamide resin, a polyimide resin, a polyetheretherketone resin may be suitable as resin 15 impregnated within sintered metal layers 16.

In addition, a solid lubricant may be added to the metal forming layers 16. The addition of such a solid lubricant may achieve a superior slide-contact and prevent seizure of swash plate surfaces sliding against shoes 13. As an example, any of or combinations chosen from graphite, molybdenum disulfide, tungsten disulfide, boron nitride, antimony oxide, indium, stannum, argentum, and plumbum may be suitable as the solid lubricant.

Moreover, a solid lubricant may be added to resin 15. The addition of such a solid lubricant may achieve superior slide-contact and prevent seizure of swash plate surfaces sliding against shoes 13. As an example, any of or combinations chosen from polytetrafluoroethylene resin, graphite, molybdenum disulfide, tungsten disulfide, boron nitride, antimony oxide, indium, stannum, argentum, and plumbum may be suitable as the solid lubricant.

Further, it is not necessarily that layers 16 of the sintered metal impregnated with resin 15 be formed on both sides of swash plate surfaces sliding against shoes 13. Layer 16 of the sintered metal impregnated with resin 15 may be formed on one side surface of swash plate 12 sliding against shoe 13, and layer 16 of the sintered metal, which is not impregnated with resin 15, may be formed on the other side surface of swash plate 12 sliding against the other shoe 13. Moreover, layer 16 of the sintered metal impregnated with resin 15 may be formed on one side surface of swash plate 12 sliding against shoe 13, and resin 15 may be pressed on the other side surface of swash plate 12 sliding against shoe 13. Alternatively, layer 16 of the sintered metal impregnated with resin 15 may be formed on one side surface of swash plate 12 sliding against shoe 13, and another arbitrary treatment, by which a superior sliding-contact against shoe 13 may be achieved, and seizure of the swash plate surface sliding against shoe 13 may be prevented, may be adapted.

Although embodiments of the present invention have been described in detail herein, the scope of the invention is not limited thereto. It will be appreciated by those skilled in the art that various modifications may be made without departing from the scope of the invention. Accordingly, embodiments disclosed herein are only exemplary. It is to be understood that the scope of the invention is not be limited thereby, but is to be determined by the claims, which follow.

What is claimed is:

1. A swash plate-type compressor comprising:

a rotatable swash plate;

a piston is connected to said swash plate via at least one shoe and reciprocates in company with each rotation of said swash plate; and wherein said swash plate comprises a layer of a sintered metal impregnated with a resin on at least a swash plate surface sliding against said at least one shoe, and a surface of said layer is ground, wherein said metal comprises a solid lubricant and wherein said solid lubricant is selected from the group consisting of tungsten disulfide, boron nitride, antimony oxide, indium, stannum, argentum, and plumbum.

2. A swash plate-type compressor of claim 1, wherein said metal is selected from the group consisting of a copper alloy and an aluminum alloy.

3. A swash plate-type compressor of claim 1, wherein said resin is a thermoplastic resin.

4. A swash plate-type compressor of claim 1, wherein said resin is a thermosetting resin.

5. A swash plate-type compressor of claim 1, wherein said resin is an epoxy resin.

6. A swash plate-type compressor of claim 1, wherein said resin is a phenol resin.

7. A swash plate-type compressor of claim 1, wherein said resin is a polyimideamide resin.

8. A swash plate-type compressor of claim 1, wherein said resin is a polyimide resin.

9. A swash plate-type compressor comprising:

a rotatable swash plate;

a piston is connected to said swash plate via at least one shoe and reciprocates in company with each rotation of said swash plate; and wherein said swash plate comprises a layer of a sintered metal impregnated with a resin on at least a swash plate surface sliding against said at least one shoe, and a surface of said layer is ground, and wherein said resin is a polyetheretherketone resin.

10. A swash plate-type compressor comprising:

a rotatable swash plate;

a piston is connected to said swash plate via at least one shoe and reciprocates in company with each rotation of said swash plate; and wherein said swash plate comprises a layer of a sintered metal impregnated with a resin on at least a swash plate surface sliding against said at least one shoe, and a surface of said layer is ground, wherein said resin comprises a solid lubricant and wherein said solid lubricant is selected from the group consisting of tungsten disulfide, boron nitride, antimony oxide, indium, stannum, argentum, and plumbum.

11. A swash plate-type compressor of claim 10, wherein said resin is a thermoplastic resin.

12. A swash plate-type compressor of claim 10, wherein said resin is a thermosetting resin.

13. A swash plate-type compressor of claim 10, wherein said resin is an epoxy resin.

14. A swash plate-type compressor of claim 10, wherein said resin is a phenol resin.

15. A swash plate-type compressor of claim 10, wherein said resin is a polyimideamide resin.

16. A swash plate-type compressor of claim 10, wherein said resin is a polyimide resin.

17. A method for manufacturing a swash plate-type compressor, wherein said compressor comprises a rotatable swash plate and a piston, said piston is connected to said swash plate via at least one shoe and reciprocates in company with each rotation of said swash plate, said method comprising the steps of:

sintering a metal on said swash plate surface;

impregnating a resin into a layer of said sintered metal;

hardening said resin; and grinding an outer surface of said impregnated layer.

18. The method of claim 17, further comprising the step of adding a solid lubricant to said layer.

19. The method of claim 17, further comprising the step of adding a solid lubricant to said resin.

* * * * *